US011705083B2

(12) United States Patent
Kim et al.

(10) Patent No.: US 11,705,083 B2
(45) Date of Patent: Jul. 18, 2023

(54) DISPLAY DEVICE

(71) Applicant: SAMSUNG DISPLAY CO., LTD., Yongin-si (KR)

(72) Inventors: Sung Jun Kim, Yongin-si (KR); Sung Hee Lee, Yongin-si (KR); Deok Hwan Kim, Yongin-si (KR); Yong Su Lim, Yongin-si (KR)

(73) Assignee: SAMSUNG DISPLAY CO., LTD., Gyeonggi-Do (KR)

( * ) Notice: Subject to any disclaimer, the term of this patent is extended or adjusted under 35 U.S.C. 154(b) by 214 days.

(21) Appl. No.: 17/335,285

(22) Filed: Jun. 1, 2021

(65) Prior Publication Data

US 2022/0084479 A1 Mar. 17, 2022

(30) Foreign Application Priority Data

Sep. 17, 2020 (KR) ..... 10-2020-0120066

(51) Int. Cl.
*G09G 3/00* (2006.01)
*G09G 3/36* (2006.01)

(52) U.S. Cl.
CPC ..... *G09G 3/3648* (2013.01); *G09G 3/006* (2013.01); *G09G 3/3607* (2013.01); *G09G 2300/0426* (2013.01); *G09G 2320/0223* (2013.01); *G09G 2330/12* (2013.01)

(58) Field of Classification Search
None
See application file for complete search history.

(56) References Cited

U.S. PATENT DOCUMENTS 11,462,644 B2 * 10/2022 Otsubo ..... G09G 3/3674
2019/0340989 A1 * 11/2019 Lee ..... G09G 3/3688

FOREIGN PATENT DOCUMENTS

KR 1020160048273 A 5/2016

* cited by examiner

*Primary Examiner* — Parul H Gupta
(74) *Attorney, Agent, or Firm* — Cantor Colburn LLP

(57) ABSTRACT

A display device includes a display panel including scan lines and pixels connected to the scan lines, a first scan driver disposed outside the display panel, first scan output lines including a first terminal connected to the first scan driver and a second terminal connected to a corresponding scan line of the scan lines, and crossing the scan lines, and a first inspection line including a first receiving terminal connected to the first scan driver and a first feedback terminal connected to the first scan driver, extending from the first receiving terminal to the first feedback terminal, and crossing the scan lines.

20 Claims, 7 Drawing Sheets

DISPLAY DEVICE

This application claims priority to Korean Patent Application No. 10-2020-0120066, filed Sep. 17, 2020, and all the benefits accruing therefrom under 35 U.S.C. § 119, the content of which in its entirety is herein incorporated by reference.

BACKGROUND

1. Field

Embodiments of the invention relate to a display device.

2. Description of the Related Art

With a development of information technology, an importance of display devices, which are a connection medium between users and information, is being emphasized. Accordingly, a use of display devices such as a liquid crystal display device, an organic light emitting display device, and the like is increasing.

As a resolution and a size of a display panel of the display device increase, it is desired to compensate for a resistance-capacitance ("RC") delay of a scan signal and a data signal inside the display panel. If the RC delay is measured only once in a manufacturing process of a product, a change in the RC delay according to a use of the display panel may not be reflected.

In order to solve this problem, a line for inspecting the RC delay may be mounted on the display panel.

SUMMARY

In general, a line for inspecting the a resistance-capacitance ("RC") delay may be formed long along a periphery of the display panel. Therefore, a dead space is increased, and thus it is difficult to implement a narrow bezel.

A technical problem to be solved is to provide a display device in which a change in the RC delay over time may be compensated and a line for inspecting the RC delay may not constitute the dead space.

A display device in an embodiment of the invention may include a display panel including scan lines and pixels connected to the scan lines, a first scan driver disposed outside the display panel, first scan output lines including a first terminal connected to the first scan driver and a second terminal connected to a corresponding scan line of the scan lines, and crossing the scan lines, and a first inspection line including a first receiving terminal connected to the first scan driver and a first feedback terminal connected to the first scan driver, extending from the first receiving terminal to the first feedback terminal, and crossing the scan lines.

In an embodiment, the display device may further include a second inspection line including a second receiving terminal connected to the first scan driver and a second feedback terminal connected to the first scan driver, extending from the second receiving terminal to the second feedback terminal, and crossing the scan lines. The second inspection line may be longer than the first inspection line.

In an embodiment, the display device may further include a second scan driver disposed outside the display panel, and second scan output lines including a first terminal connected to the second scan driver and a second terminal connected to a corresponding scan line of the scan lines, and crossing the scan lines. The scan lines connected to the first scan output lines may be not connected to the second scan output lines.

In an embodiment, the second scan output lines may be longer than the first scan output lines.

In an embodiment, the display device may further include a third inspection line including a third receiving terminal connected to the second scan driver and a third feedback terminal connected to the second scan driver, extending from the third receiving terminal to the third feedback terminal, and crossing the scan lines. The third inspection line may be longer than the first inspection line and the second inspection line.

In an embodiment, the display device may further include a fourth inspection line including a fourth receiving terminal connected to the second scan driver and a fourth feedback terminal connected to the second scan driver, extending from the fourth receiving terminal to the fourth feedback terminal, and crossing the scan lines. The fourth inspection line may be longer than the first inspection line, the second inspection line, and the third inspection line.

In an embodiment, the display device may further include a third scan driver disposed outside the display panel, and third scan output lines including a first terminal connected to the third scan driver and a second terminal connected to a corresponding scan line of the scan lines, and crossing the scan lines. The scan lines connected to the first scan output lines may be connected to the third scan output lines.

In an embodiment, the display device may further include a first circuit board on which the first scan driver is disposed, a second circuit board on which the second scan driver is disposed, a third circuit board on which the third scan driver is disposed, a first auxiliary circuit board connected to the first circuit board and the second circuit board, and a second auxiliary circuit board connected to the third circuit board.

In an embodiment, the display device may further include a first data driver disposed outside the display panel, data lines including a first terminal connected to the first data driver and a second terminal connected to corresponding pixels of the pixels, and crossing the scan lines, and a delay line including a first terminal connected to the first data driver and a second terminal connected to the first scan driver.

In an embodiment, the first scan driver may output an inspection signal to the first receiving terminal, receive a feedback signal for the inspection signal from the first feedback terminal, and generate a delay signal based on the inspection signal and the feedback signal. The first data driver may receive the delay signal through the delay line.

In an embodiment, the first data driver may determine time points at which data voltages are applied to the data lines based on the delay signal.

In an embodiment, the data lines may include first data lines connected to pixels of a first color among the pixels, second data lines connected to pixels of a second color among the pixels, and third data lines connected to pixels of a third color among the pixels. The first color, the second color, and the third color are different from one another. The first scan output lines may extend between the first data lines and the second data lines closest to the first data lines.

In an embodiment, the first inspection line may further include a first portion extending between one first data line and one second data line closest to the one first data line, a second portion extending between another first data line and another second data line closest to the another first data line, and a third portion crossing at least one of the first data lines and at least one of the second data lines, and connecting the first portion and the second portion.

In an embodiment, the first inspection line and the first scan output lines may not cross each other in an area in which the pixels are disposed.

In an embodiment, the first inspection line may be disposed in a first area of the display panel, the second inspection line may be disposed in a second area of the display panel, the first scan output lines may be disposed in a third area of the display panel, the first area, the second area, and the third area may not overlap each other, and the third area may be disposed between the first area and the second area.

In an embodiment, data lines connected to the pixels may be disposed in a fourth area of the display panel. The fourth area may include the first area, the second area, and the third area.

A display device in an embodiment of the invention may include a display panel including scan lines, data lines, and pixels connected to the scan lines and the data lines, a first scan driver disposed outside the display panel, a first data driver disposed outside the display panel and connected to a part of the data lines, first scan output lines including a first terminal connected to the first scan driver and a second terminal connected to a corresponding scan line of the scan lines, and crossing the scan lines, and a first inspection line including a first receiving terminal connected to the first data driver and a first feedback terminal connected to the first data driver, extending from the first receiving terminal to the first feedback terminal, and crossing the scan lines.

In an embodiment, the display device may further include a second data driver disposed outside the display panel and connected to another part of the data lines, and a second inspection line including a second receiving terminal connected to the second data driver and a second feedback terminal connected to the second data driver, extending from the second receiving terminal to the second feedback terminal, and crossing the scan lines. The second inspection line may be longer than the first inspection line.

In an embodiment, the first data driver may output a first inspection signal to the first receiving terminal, receive a first feedback signal for the first inspection signal from the first feedback terminal, and determine time points at which data voltages are applied to some of the data lines based on the first inspection signal and the first feedback signal.

In an embodiment, the second data driver may output a second inspection signal to the second receiving terminal, receive a second feedback signal for the second inspection signal from the second feedback terminal, and determine time points at which data voltages are applied to others of the data lines based on the second inspection signal and the second feedback signal.

BRIEF DESCRIPTION OF THE DRAWINGS

The accompanying drawings, which are included to provide a further understanding of the invention, and are incorporated in and constitute a part of this specification, illustrate embodiments of the invention, and, together with the description, serve to explain principles of the invention.

DETAILED DESCRIPTION

Figure 1:
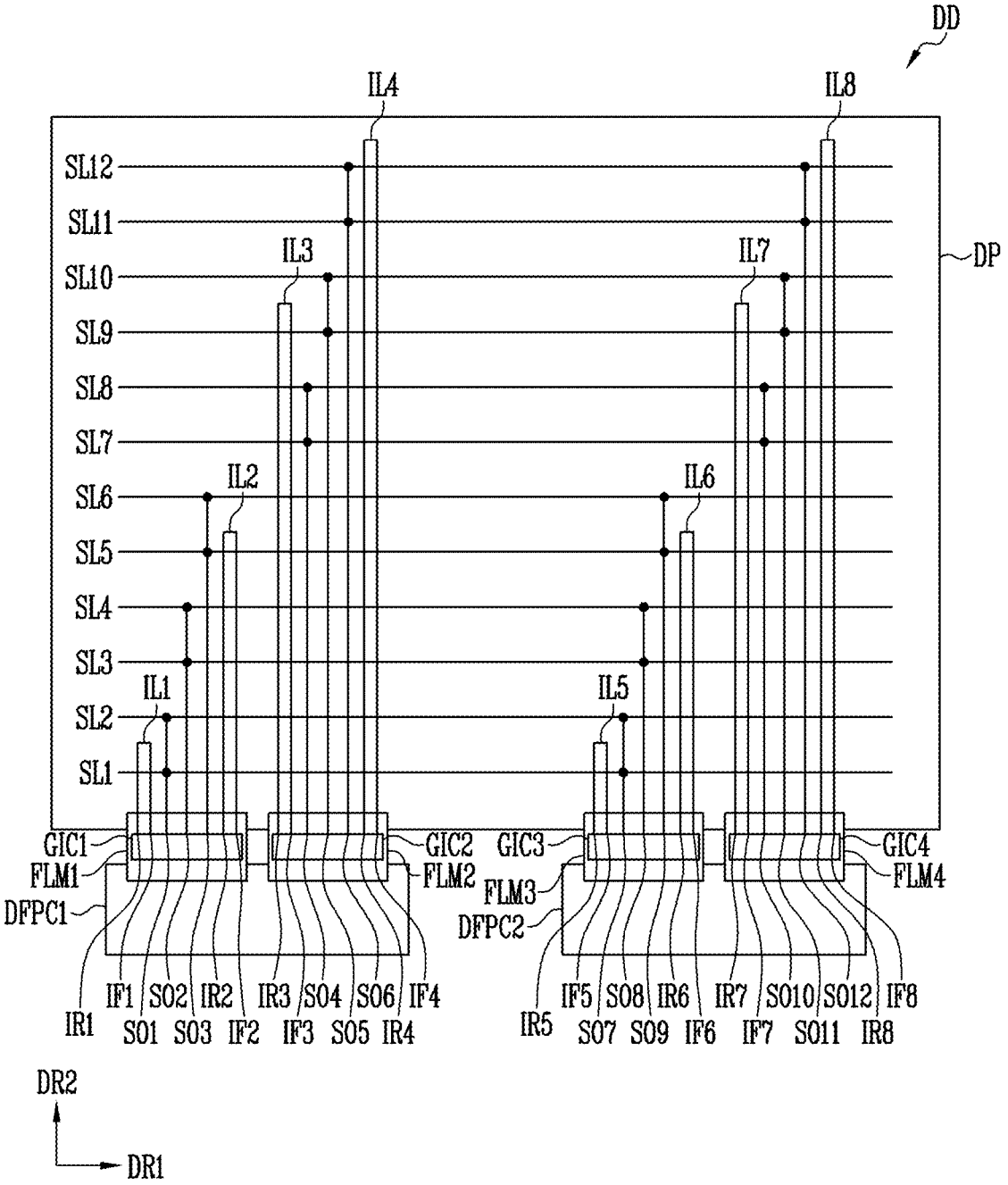
FIG. 1 is a diagram for explaining an embodiment of a display device according to the invention.

Hereinafter, embodiments of the invention will be described in detail with reference to the accompanying drawings so that those of ordinary skill in the art may easily implement the invention. Embodiments of the invention may be embodied in various different forms and is not limited to the embodiments described herein.

In order to clearly describe the invention, parts that are not related to the description are omitted, and the same or similar components are denoted by the same reference numerals throughout the specification. Therefore, the above-mentioned reference numerals can be used in other drawings.

In addition, the size and thickness of each component shown in the drawings are arbitrarily shown for convenience of description, and thus the invention is not necessarily limited to those shown in the drawings. In the drawings, thicknesses may be exaggerated to clearly express the layers and regions.

In addition, in the description, the expression "is the same" may mean "substantially the same". That is, it may be the same enough to convince those of ordinary skill in the art to be the same. In other expressions, "substantially" may be omitted.

It will be understood that when an element is referred to as being "on" another element, it can be directly on the other element or intervening elements may be therebetween. In contrast, when an element is referred to as being "directly on" another element, there are no intervening elements present.

It will be understood that, although the terms "first," "second," "third" etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, "a first element," "component," "region," "layer" or "section" discussed below could be termed a second element, component, region, layer or section without departing from the teachings herein.

The terminology used herein is for the purpose of describing particular embodiments only and is not intended to be limiting. As used herein, the singular forms "a," "an," and "the" are intended to include the plural forms, including "at least one," unless the content clearly indicates otherwise. "Or" means "and/or." As used herein, the term "and/or" includes any and all combinations of one or more of the associated listed items. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. In an embodiment, when the device in one of the figures is turned over, elements described as being on the "lower" side of other elements would then be oriented on "upper" sides of the other elements. The exemplary term "lower," can therefore, encompasses both an orientation of "lower" and "upper," depending on the particular orientation of the figure. Similarly, when the device in one of the figures is turned over, elements described as "below" or "beneath" other elements would then be oriented "above" the other elements. The exemplary terms "below" or "beneath" can, therefore, encompass both an orientation of above and below.

"About" or "approximately" as used herein is inclusive of the stated value and means within an acceptable range of deviation for the particular value as determined by one of ordinary skill in the art, considering the measurement in question and the error associated with measurement of the particular quantity (i.e., the limitations of the measurement system). For example, "about" can mean within one or more standard deviations, or within ±30%, 20%, 10%, 5% of the stated value.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and the invention, and will not be interpreted in an idealized or overly formal sense unless expressly so defined herein.

FIG. 1 is a diagram for explaining an embodiment of a display device according to the invention.

Referring to FIG. 1, a display device DD in an embodiment of the invention may include a display panel DP, circuit boards FLM1, FLM2, FLM3, and FLM4, and auxiliary circuit boards DFPC1 and DFPC2.

Figure 2:
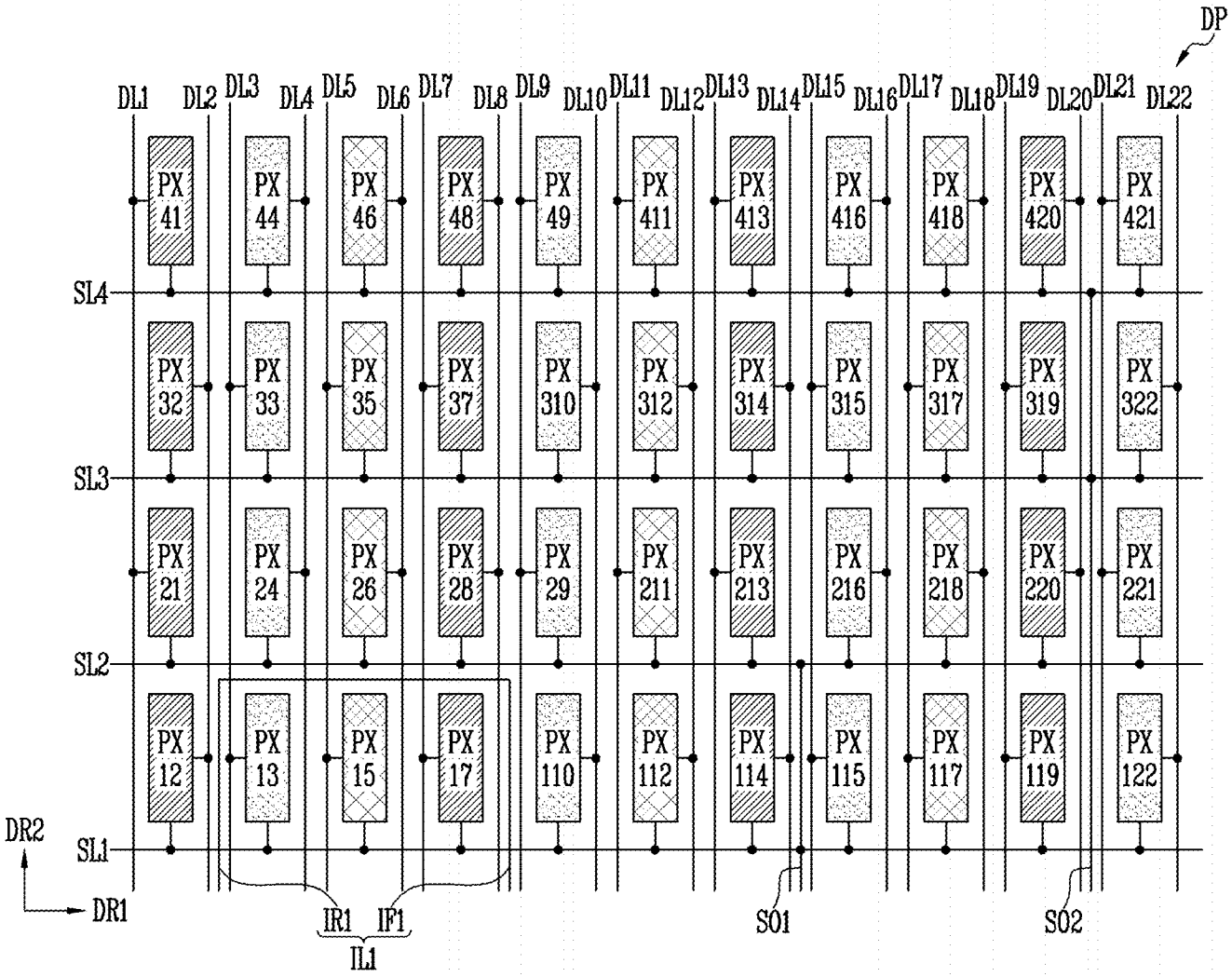
FIG. 2 is a diagram for explaining an embodiment of a display panel according to the invention.

However, FIG. 1 illustrates only some components of the display device DD due to an insufficient space of a paper. FIG. 2 specifically illustrates the display panel DP, and FIG. 4 specifically illustrates a first circuit board FLM1.

The display panel DP may include scan lines SL1, SL2, SL3, SL4, SL5, SL6, SL7, SL8, SL9, SL10, SL11, and SL12 and pixels connected to the scan lines SL1 to SL12. Although not shown in FIG. 1, the pixels may be further connected to data lines. Each pixel may be selected when a scan signal of a turn-on level is applied to a corresponding scan line, and may receive a data voltage applied to a corresponding data line. Each pixel may emit light with a luminance corresponding to the received data voltage. Accordingly, the display panel DP may display an image using a combination of light emitted from the pixels.

The scan lines SL1 to SL12 may extend in a first direction DR1 and may be arranged in a second direction DR2. The first direction DR1 and the second direction DR2 may be orthogonal to each other. When the display panel DP has a planar shape, the first direction DR1 and the second direction DR2 may be directions defining a plane. The scan lines SL1 to SL12 may have the same length. Although not shown in FIG. 1, the data lines may extend in the second direction DR2 and may be arranged in the first direction DR1. On the display panel DP, the data lines may have the same length.

Each of the display panel DP and the circuit boards FLM1 to FLM4 may include a plurality of pad electrodes. The pad electrodes of each of the circuit boards FLM1 to FLM4 may be connected to corresponding pad electrodes of the display panel DP. The circuit boards FLM1 to FLM4 may be in the form of a flexible film (e.g., a chip on film ("COF")).

A first scan driver GIC1 may be disposed on the first circuit board FLM1. That is, the first scan driver GIC1 may be disposed outside the display panel DP. Accordingly, since the scan driver does not need to be disposed (e.g., mounted) on the display panel DP, the dead space of the display panel DP may be reduced.

First scan output lines SO1, SO2, and SO3 may include a first terminal connected to the first scan driver GIC1 and a second terminal connected to a corresponding scan line, and extend to cross the scan lines. In an embodiment, the first scan output lines SO1, SO2, and SO3 may be connected to different scan lines, respectively, for example. In an embodiment, a first scan output line SO1 may be connected to the scan lines SL1 and SL2, a first scan output line SO2 may be connected to the scan lines SL3 and SL4, and a first scan output line SO3 may be connected to the scan lines SL5 and SL6, for example. In another embodiment, one first scan output line may be connected to only one scan line.

On the display panel DP, the first scan output lines SO1, SO2, and SO3 may extend in the second direction DR2 and may be arranged in the first direction DR1. The lengths of the first scan output lines SO1, SO2, and SO3 may be different. In an embodiment, based on the position in the first direction DR1, the lengths of the first scan output lines SO1, SO2, and SO3 may gradually increase, for example.

A first inspection line IL1 may include a first receiving terminal IR1 connected to the first scan driver GIC1 and a first feedback terminal IF1 connected to the first scan driver GIC1. The first receiving terminal IR1 and the first feedback terminal IF1 may be connected to different pins of the first scan driver GIC1. In an embodiment, the different pins may be different electrical nodes, for example. The first inspection line IL1 may extend from the first receiving terminal IR1 to the first feedback terminal IF1 and may extend to cross the scan lines.

A second inspection line IL2 may include a second receiving terminal IR2 connected to the first scan driver GIC1 and a second feedback terminal IF2 connected to the first scan driver GIC1. The second receiving terminal IR2 and the second feedback terminal IF2 may be connected to different pins of the first scan driver GIC1. In an embodiment, the different pins may be different electrical nodes, for example. The second inspection line IL2 may extend from the second receiving terminal IR2 to the second feedback terminal IF2 and may extend to cross the scan lines.

In an embodiment, the second inspection line IL2 may be longer than the first inspection line ILL for example. The relatively short first inspection line IL1 may be disposed near the relatively short first scan output line SO1. Further, the relatively long second inspection line IL2 may be disposed near the relatively long first scan output line SO3. Accordingly, when the first inspection line IL1 is used, it is possible to easily inspect a resistance-capacitance ("RC") delay of the first scan output line SO1 and the first scan output lines adjacent thereto. In addition, when the second inspection line IL2 is used, it is possible to easily inspect the RC delay of the first scan output line SO3 and the first scan output lines adjacent thereto.

In an embodiment, the width, thickness, material, and the like of the inspection lines IL1 and IL2 may be configured the same as those of the first scan output lines SO1, SO2, and SO3, for example. As will be described with reference to FIG. 2, the arrangement positions of the inspection lines IL1 and IL2 may be similar to those of the first scan output lines SO1, SO2, and SO3. Accordingly, when the inspection lines IL1 and IL2 are used, it is possible to easily inspect the RC delay of the first scan output lines SO1, SO2 and SO3.

In another embodiment, the width, thickness, material, and the like of at least one of the inspection lines IL1 and IL2 may be configured the same as those of the data lines. Accordingly, when at least one of the inspection lines IL1 and IL2 is used, it is possible to easily inspect the RC delay of the data lines.

A second scan driver GIC2 may be disposed on a second circuit board FLM2. That is, the second scan driver GIC2 may be disposed outside the display panel DP. Accordingly, since the scan driver does not need to be disposed (e.g., mounted) on the display panel DP, the dead space of the display panel DP may be reduced.

Second scan output lines SO4, SO5, and SO6 may include a first terminal connected to the second scan driver GIC2 and a second terminal connected to a corresponding scan line, and may extend to cross the scan lines. In an embodiment, the second scan output lines SO4, SO5, and SO6 may be connected to different scan lines, respectively, for example. Also, the scan lines SL1 to SL6 connected to the first scan output lines SO1, SO2 and SO3 may not be connected to the second scan output lines SO4, SO5, and SO6.

In an embodiment, a second scan output line SO4 may be connected to the scan lines SL7 and SL8, a second scan output line SO5 may be connected to the scan lines SL9 and SL10, and a second scan output line SO6 may be connected to the scan lines SL11 and SL12, for example. In another embodiment, one second scan output line may be connected to only one scan line.

On the display panel DP, the second scan output lines SO4, SO5, and SO6 may extend in the second direction DR2 and may be arranged in the first direction DR1. The lengths of the second scan output lines SO4, SO5, and SO6 may be different. In an embodiment, based on the position in the first direction DR1, the lengths of the second scan output lines SO4, SO5 and SO6 may gradually increase, for example. On the display panel DP, the second scan output lines SO4, SO5, and SO6 may be longer than the first scan output lines SO1, SO2, and SO3.

A third inspection line IL3 may include a third receiving terminal IR3 connected to the second scan driver GIC2 and a third feedback terminal IF3 connected to the second scan driver GIC2. The third receiving terminal IR3 and the third feedback terminal IF3 may be connected to different pins of the second scan driver GIC2. In an embodiment, the different pins may be different electrical nodes, for example. The third inspection line IL3 may extend from the third receiving terminal IR3 to the third feedback terminal IF3 and may extend to cross the scan lines. In an embodiment, on the display panel DP, the third inspection line IL3 may be longer than the first inspection line IL1 and the second inspection line IL2, for example.

A fourth inspection line IL4 may include a fourth receiving terminal IR4 connected to the second scan driver GIC2 and a fourth feedback terminal IF4 connected to the second scan driver GIC2. The fourth receiving terminal IR4 and the fourth feedback terminal IF4 may be connected to different pins of the second scan driver GIC2. In an embodiment, the different pins may be different electrical nodes, for example. The fourth inspection line IL4 may extend from the fourth receiving terminal IR4 to the fourth feedback terminal IF4 and may extend to cross the scan lines. In an embodiment, on the display panel DP, the fourth inspection line IL4 may be longer than the first inspection line ILL the second inspection line IL2, and the third inspection line IL3, for example.

In an embodiment, the relatively short third inspection line IL3 may be disposed near the relatively short second scan output line SO4, for example. Further, the relatively long fourth inspection line IL4 may be disposed near the relatively long second scan output line SO6. Accordingly, when the third inspection line IL3 is used, it is possible to easily inspect the RC delay of the second scan output line SO4 and the second scan output lines adjacent thereto. In addition, when the fourth inspection line IL4 is used, it is possible to easily inspect the RC delay of the second scan output line SO6 and the second scan output lines adjacent thereto.

In an embodiment, the width, thickness, material, and the like of the inspection lines IL3 and IL4 may be configured the same as those of the second scan output lines SO4, SO5, and SO6, for example. The arrangement positions of the inspection lines IL3 and IL4 may be similar to those of the second scan output lines SO4, SO5 and SO6. Accordingly, when the inspection lines IL3 and IL4 are used, it is possible to easily inspect the RC delay of the second scan output lines SO4, SO5 and SO6.

In another embodiment, the width, thickness, material, and the like of at least one of the inspection lines IL3 and IL4 may be configured the same as those of the data lines. Accordingly, when at least one of the inspection lines IL3 and IL4 is used, it is possible to easily inspect the RC delay of the data lines.

A first auxiliary circuit board DFPC1 may be a rigid printed circuit board or a flexible printed circuit board. The first auxiliary circuit board DFPC1 may be connected to the first circuit board FLM1 and the second circuit board FLM2. In an embodiment, pad electrodes of the first auxiliary circuit board DFPC1 may be connected to pad electrodes of the first circuit board FLM1 and the second circuit board FLM2, for example. In an embodiment, elements desiring a physically large area, such as a resistor element and a capacitor element, may be disposed on the first auxiliary circuit board DFPC1, for example.

The scan drivers GIC1 and GIC2 and data drivers may be connected to a timing controller (not shown) through the first auxiliary circuit board DFPC1. The timing controller may receive grayscales for an image frame and control signals from an external processor, and control the scan drivers GIC1 and GIC2 and the data drivers using them.

A second auxiliary circuit board DFPC2 may be connected to a third circuit board FLM3 and a fourth circuit board FLM4. A third scan driver GIC3 may be disposed on the third circuit board FLM3, and a fourth scan driver GIC4 may be disposed on the fourth circuit board FLM4. The scan drivers GIC3 and GIC4 and the data drivers may be connected to the timing controller described above through the second auxiliary circuit board DFPC2.

The third scan driver GIC3 may be disposed outside the display panel DP. Third scan output lines SO7, SO8, and SO9 may include a first terminal connected to the third scan driver GIC3 and a second terminal connected to a corresponding scan line, and may extend to cross the scan lines. In this case, the scan lines SL1 to SL6 connected to the first scan output lines SO1, SO2, and SO3 may be connected to the third scan output lines SO7, SO8, and SO9. Accordingly, the pixels farther from the first scan output lines SO1, SO2 and SO3 in the first direction DR1 may also quickly receive scan signals from the third scan output lines SO7, SO8, and SO9. Therefore, the RC delay may be reduced.

The third circuit board FLM3, the third scan driver GIC3, the third scan output lines SO7, SO8, and SO9, a fifth inspection line IL5 extending from a fifth receiving terminal IR5 to a fifth feedback terminal IF5, and a sixth inspection line IL6 extending from a sixth receiving terminal IR6 to a sixth feedback terminal IF6 may correspond to the first circuit board FLM1, the first scan driver GIC1, the first scan output lines SO1, SO2, and SO3, the first inspection line ILL and the second inspection line IL2 described above and thus duplicate descriptions will be omitted.

In addition, the fourth circuit board FLM4, the fourth scan driver GIC4, fourth scan output lines SO10, SO11, and 5012, a seventh inspection line IL7 extending from a seventh receiving terminal IR7 to a seventh feedback terminal IF7, and an eighth inspection line IL8 extending from an eighth receiving terminal IR8 to an eighth feedback terminal IF8 may correspond to the second circuit board FLM2, the second scan driver GIC2, the second scan output lines SO4, SO5, and SO6, the third inspection line IL3, and the fourth inspection line IL4 described above, and thus duplicate descriptions will be omitted.

However, the number of inspection lines IL1 to IL8 may be smaller than the number of scan output lines SO1 to SO12. It is difficult to form each inspection line exactly the same as each scan output line. Accordingly, it may be unnecessary for the inspection lines to correspond one-to-one with the scan output lines. The RC delay for each scan output line may be calculated by calculating (e.g., interpolating) the inspection result. Accordingly, the cost of configuring the inspection lines IL1 to IL8 may be reduced.

FIG. 2 is a diagram for explaining an embodiment of a display panel according to the invention.

FIG. 2 illustrates an enlarged view of an area near the first inspection line IL1 of the display panel DP of FIG. 1.

On the display panel DP, data lines DL1 to DL22 may extend in the second direction DR2 and may be arranged in the first direction DR1. The data lines DL1 to DL22 may include first data lines DL1, DL2, DL7, DL8, DL13, DL14, DL19, and DL20 connected to pixels PX12, PX21, PX32, PX41, PX17, PX28, PX37, PX48, PX114, PX213, PX314, PX413, PX119, PX220, PX319, and PX420 of a first color, second data lines DL3, DL4, DL9, DL10, DL15, DL16, DL21, and DL22 connected to pixels PX13, PX24, PX33, PX44, PX110, PX29, PX310, PX49, PX115, PX216, PX315, PX416, PX122, PX221, PX322, and PX421 of a second color, and third data lines DL5, DL6, DL11, DL12, DL17, and DL18 connected to pixels PX15, PX26, PX35, PX46, PX112, PX211, PX312, PX411, PX117, PX218, PX317, and PX418 of a third color.

Here, the color may mean the color of light emitted by each pixel. The first color, the second color, and the third color may be different from one another. In an embodiment, the first color may be one of red, green, and blue, the second color may be one other than the first color among red, green, and blue, and the third color may be one other than the first color and the second color among red, green, and blue, for example. In addition, magenta, cyan, and yellow may be used instead of red, green, and blue as the first to third colors. However, in the illustrated embodiment, for convenience of explanation, it is assumed that the first color is red, the second color is blue, and the third color is green.

In an embodiment, the pixels PX12, PX21, PX32, and PX41 of the first color may be alternately connected to two closest first data lines DL1 and DL2, for example. Similarly, the pixels PX13, PX24, PX33, and PX44 of the second color may be alternately connected to two closest second data lines DL3 and DL4. Also, the pixels PX15, PX26, PX35, and PX46 of the third color may be alternately connected to two closest third data lines DL5 and DL6.

The first scan output lines SO1 and SO2 may extend between the first data line DL14 and the second data line DL15 that is closest to the first data lines DL14 or between the first data line DL20 and the second data line DL21 that is closest to the first data line DL20. In an embodiment, the first scan output line SO1 may extend between a first data line DL14 and a second data line DL15, for example. Also, the first scan output line SO2 may extend between a first data line DL20 and a second data line DL21.

The first inspection line IL1 may include a first portion extending from the first receiving terminal IR1, a second portion extending from the first feedback terminal IF1, and a third portion connecting the first portion and the second portion.

The first portion may extend between one first data line DL2 and one second data line DL3 closest to the one first data line DL2.

The second portion may extend between another first data line DL8 and another second data line DL9 closest to the another first data line DL8.

The third portion may extend to cross at least one DL7 and DL8 of the first data lines DL1, DL2, DL7, DL8, DL13, DL14, DL19, and DL20 and at least one DL3 and DL4 of the second data lines DL3, DL4, DL9, DL10, DL15, DL16, DL21, and DL22, and connect the first portion and the second portion. Also, the third portion may extend to cross at least one DL5 and DL6 of the third data lines DL5, DL6, DL11, DL12, DL17, and DL18.

In the illustrated embodiment, the first scan output lines SO1 and SO2 may extend between adjacent data lines of red and blue pixels. Further, the first and second portions of the first inspection line IL1 may extend between the adjacent data lines of the red and blue pixels. That is, as the arrangement of the first inspection line IL1 becomes similar to the arrangement of the first scan output lines SO1 and SO2, when the first inspection line IL1 is used, it is possible to easily inspect the RC delay of the first scan output lines SO1 and SO2.

In the illustrated embodiment, the first inspection line IL1 and the first scan output lines SO1 and SO2 may not cross each other in an area in which the pixels PX12 to PX421 are disposed.

Since the same or similar structure may be applied to the other inspection lines IL2 to IL8 and the other scan output lines SO4 to 5012, duplicate descriptions will be omitted.

Figure 3:
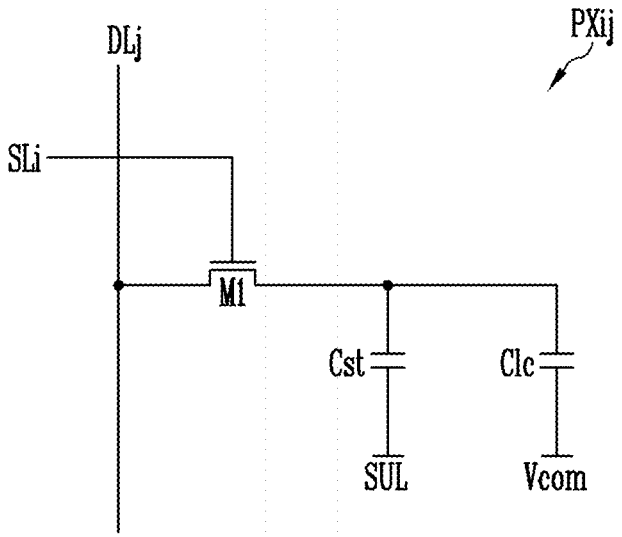
FIG. 3 is a diagram for explaining an embodiment of a pixel according to the invention.

FIG. 3 is a diagram for explaining an embodiment of a pixel according to the invention.

Referring to FIG. 3, a pixel PXij may include a transistor M1, a storage capacitor Cst, and a liquid crystal capacitor Clc. Here, i and j may be natural numbers. Hereinafter, it is assumed that the pixel PXij is a pixel of a liquid crystal display panel, but in other embodiments, the pixel may be a pixel of an organic light emitting display panel, an inorganic light emitting display panel, or the like.

In the illustrated embodiment, the transistor M1 is shown as an n-type transistor. Therefore, the turn-on level of the scan signal may be a high level. However, the invention is not limited thereto, and those skilled in the art may configure a pixel circuit having the same function using a p-type transistor.

The transistor M1 may include a gate electrode connected to a scan line SLi, a first electrode connected to a data line DLj, and a second electrode connected to a first electrode of the storage capacitor Cst and a pixel electrode of the liquid crystal capacitor Clc.

The storage capacitor Cst may include the first electrode connected to the second electrode of the transistor M1 and a second electrode connected to a sustain voltage line SUL. In an embodiment, when the liquid crystal capacitor Clc has a sufficient capacitance, the configuration of the storage capacitor Cst may be excluded.

The liquid crystal capacitor Clc may include the pixel electrode connected to the second electrode of the transistor M1 and a common electrode to which a common voltage Vcom is applied. A liquid crystal layer may be disposed between the pixel electrode and the common electrode of the liquid crystal capacitor Clc. The common electrode may be an electrode shared by a plurality of pixels or all pixels of the display panel DP. That is, the same common voltage may be applied to the plurality of pixels or all pixels through the common electrode.

When the scan signal of the turn-on level is supplied to the gate electrode of the transistor M1 through the scan line SLi, the transistor M1 may connect the data line DLj and the first electrode of the storage capacitor Cst. Accordingly, a voltage corresponding to a difference between a data voltage applied through the data line DLj and a sustain voltage of the sustain voltage line SUL may be stored in the storage capacitor Cst. The data voltage may be maintained at the pixel electrode of the liquid crystal capacitor Clc by the storage capacitor Cst. Accordingly, an electric field corresponding to a difference between the data voltage and the common voltage may be applied to the liquid crystal layer, and an orientation of liquid crystal molecules of the liquid crystal layer may be determined according to the electric field. Transmittance may correspond to the orientation of the liquid crystal molecules.

The display panel DP may further include a polarizing plate, a color filter, and the like according to the conventional techniques. The color of the pixel PXij may be determined by the color of the color filter. In addition, the display device DD may further include a backlight unit.

Figure 4:
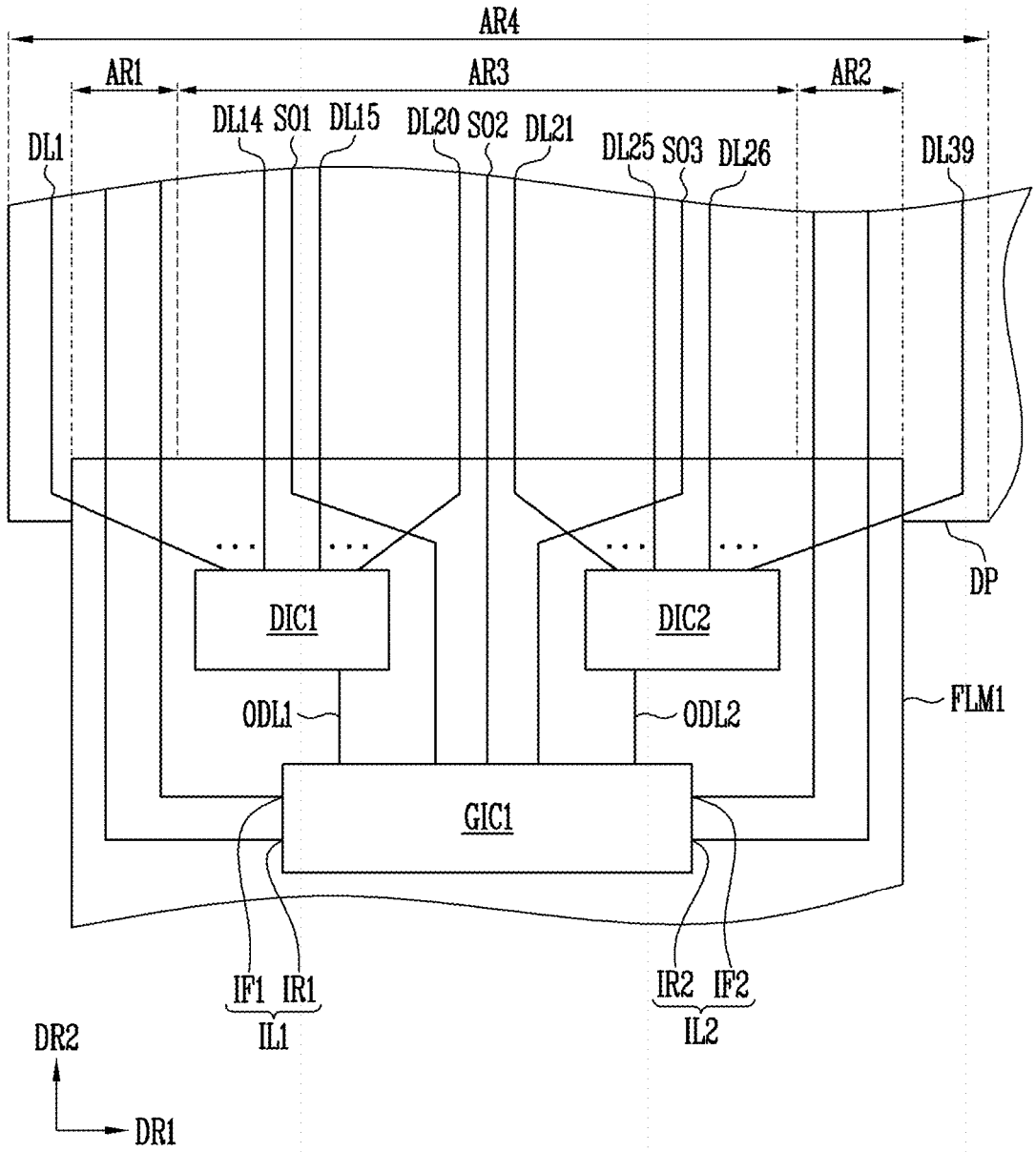
FIG. 4 is a diagram for explaining an embodiment of a first circuit board according to the invention.

FIG. 4 is a diagram for explaining an embodiment of a first circuit board according to the invention.

A first data driver DIC1 and a second data driver DIC2 may be disposed on the first circuit board FLM1. That is, the first and second data drivers DIC1 and DIC2 may be disposed outside the display panel DP.

Data lines DL1 to DL14 and DL15 to DL20 may include a first terminal connected to the first data driver DIC1 and a second terminal connected to corresponding pixels, and may extend to cross the scan lines on the display panel DP. Data lines DL21 to DL25 and DL26 to DL39 may include a first terminal connected to the second data driver DIC2 and a second terminal connected to corresponding pixels, and may extend to cross the scan lines on the display panel DP.

A first delay line ODL1 may include a first terminal connected to the first data driver DIC1 and a second terminal connected to the first scan driver GIC1. A second delay line ODL2 may include a first terminal connected to the second data driver DIC2 and a second terminal connected to the first scan driver GIC1.

In an embodiment, the first inspection line IL1 may be disposed in a first area AR1 of the display panel DP. The second inspection line IL2 may be disposed in a second area AR2 of the display panel DP. Also, the first scan output lines SO1, SO2, and SO3 may be disposed in a third area AR3 of the display panel DP. In this case, the first area AR1, the second area AR2, and the third area AR3 may not overlap each other. In this case, the third area AR3 may be disposed between the first area AR1 and the second area AR2.

In addition, the data lines connected to the pixels may be disposed in a fourth area AR4 of the display panel DP, and the fourth area AR4 may include the first area AR1, the second area AR2, and the third area AR3.

The fourth area AR4 corresponding to the first circuit board FLM1 may be adjacent to the fourth area corresponding to the second circuit board FLM2. The fourth area AR4 corresponding to the first circuit board FLM1 may not overlap with the fourth area corresponding to the second circuit board FLM2.

The third area AR3 corresponding to the first circuit board FLM1 may be disposed in the middle of the fourth area AR4. In addition, the third area corresponding to each of the other circuit boards FLM2, FLM3, and FLM4 may also be disposed in the middle of each fourth area. Accordingly, contact points of the scan output lines with respect to the scan lines may be uniformly arranged based on the first direction DR1.

In the illustrated embodiment, a space not occupied by the third area AR3 in the fourth area AR4 may be used as the first area AR1 and the second area AR2. Accordingly, there is an advantage that the inspection lines IL1 to IL8 may be arranged without increasing the dead space.

Figure 5:
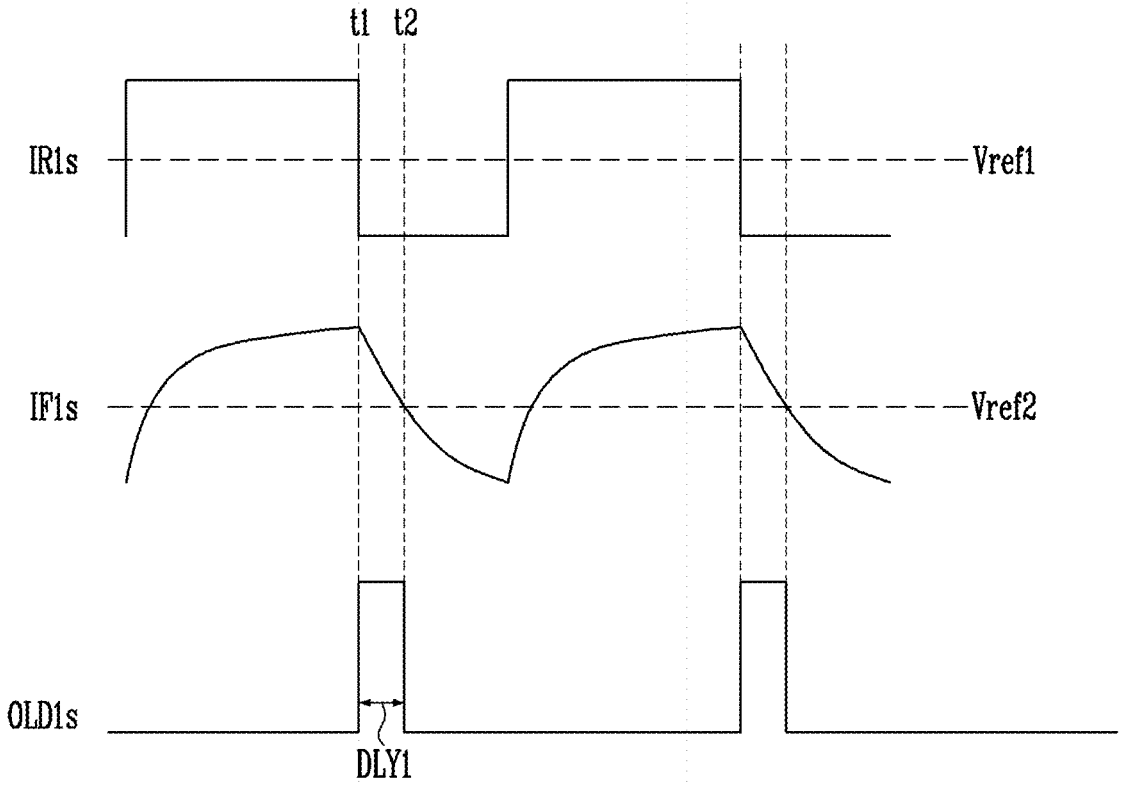
FIG. 5 is a diagram for explaining an embodiment of a method for inspecting a resistance-capacitance ("RC") delay according to the invention.

FIG. 5 is a diagram for explaining an embodiment of a method for inspecting the RC delay according to the invention. This will be described with further reference to the structure of FIG. 4.

The first scan driver GIC1 may output a first inspection signal IR1*s* to the first receiving terminal IR1, and receive a first feedback signal IF1*s* for the first inspection signal IR1*s* from the first feedback terminal IF1.

In an embodiment, the first scan driver GIC1 may generate a first delay signal ODL1*s* based on the first inspection signal IR1*s* and the first feedback signal IF1*s*. The first delay signal ODL1*s* may include information on a first delay time DLY1. In an embodiment, the first delay signal ODL1*s* may include at least one pulse having a width of the first delay time DLY1, for example.

In an embodiment, the first scan driver GIC1 may generate the first delay signal ODL1*s* by a difference between a time point t2 when the first feedback signal IF1*s* reaches a second reference voltage Vref2 and a time point t1 when the first inspection signal IR1*s* reaches a first reference voltage Vref1, for example. The difference between the time point t2 and the time point t1 may be the same as the first delay time DLY1.

The first reference voltage Vref1 and the second reference voltage Vref2 may be the same as or different from each other. In the embodiment of FIG. 5, the first delay time DLY1 is measured based on a falling transition of the signals IR1*s* and IF1*s*. However, in another embodiment, a rising transition may be used. The logic circuit for deriving the first delay time DLY1 may be implemented using the conventional techniques.

The first data driver DIC1 may receive the first delay signal ODL1*s* through the first delay line ODL1. The first data driver DIC1 may determine time points at which data voltages are applied to the data lines DL1 to DL14 and DL15 to DL20 based on the first delay signal ODL1*s*.

Since the method for inspecting the RC delay may be used in the same manner for the second data driver DIC2 and the second delay line ODL2, duplicate descriptions thereof will be omitted.

Since the method for inspecting the RC delay in the illustrated embodiment is performed through the inspection line independent from the scan lines and the data lines, there is no restriction on the inspection time. In an embodiment, after the display device DD is powered on, the method may be performed before the display of the display panel DP, or the method may be performed even while the display panel DP is being displayed, for example. In an embodiment, the method for inspecting the RC delay may be performed in a blank period in which grayscales for the pixels are not transmitted to the first and second data drivers DIC1 and DIC2, or may be performed in an active period in which the grayscales for the pixels are transmitted to the first and second data drivers DIC1 and DIC2, for example. The blank period may include a horizontal blank period in units of pixel rows and a vertical blank period in units of frames.

Figure 6:
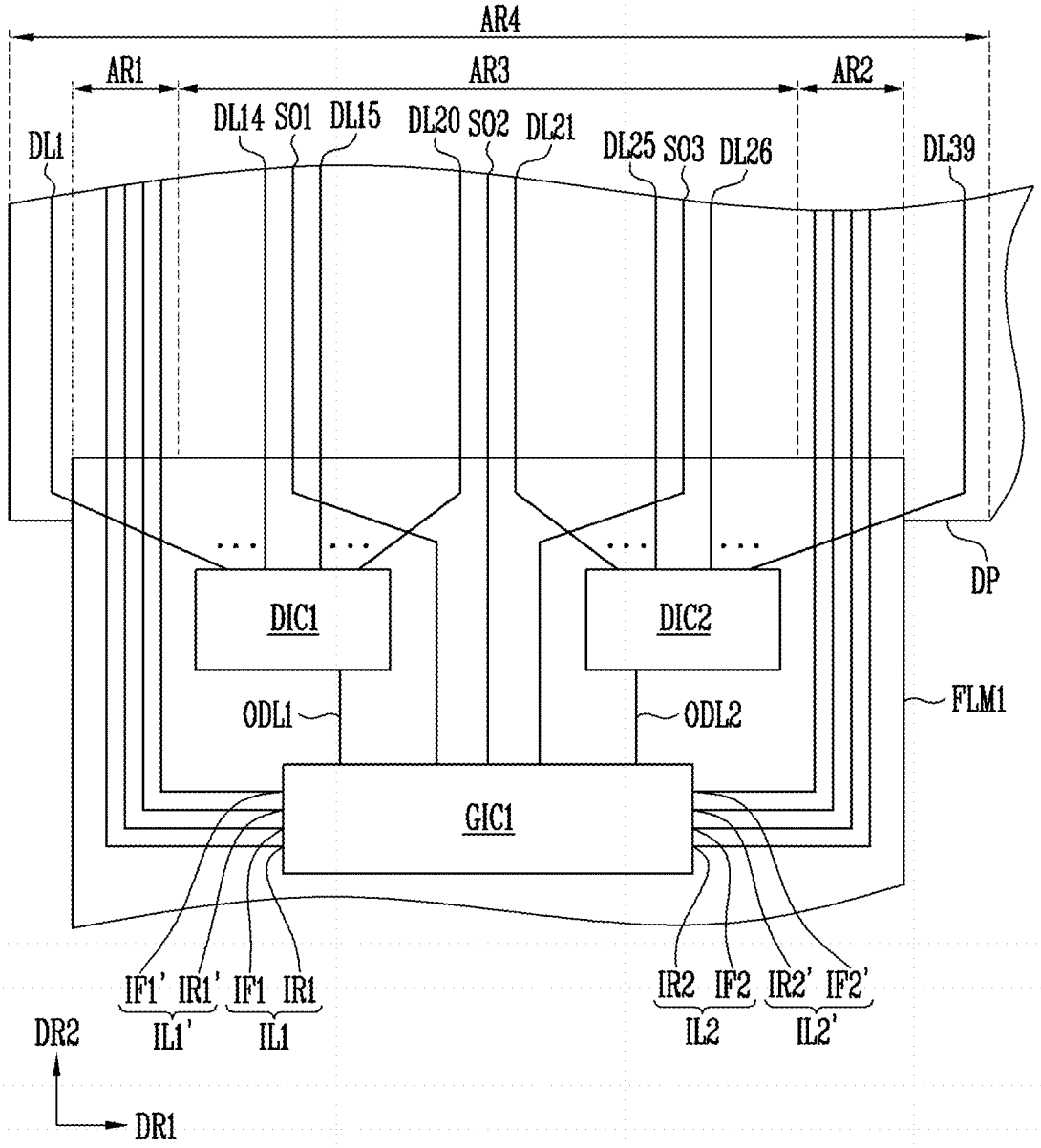
FIG. 6 is a diagram for explaining another embodiment of a first circuit board according to the invention.

FIG. 6 is a diagram for explaining another embodiment of a first circuit board according to the invention.

A first circuit board FLM1 of FIG. 6 may further include a first additional inspection line IL1' and a second additional inspection line IL2' compared to the first circuit board FLM1 of FIG. 4.

The first additional inspection line IL1' may include a first additional receiving terminal IR1' connected to the first scan driver GIC1 and a first additional feedback terminal IF1' connected to the first scan driver GIC1. The first additional receiving terminal IR1' and the first additional feedback terminal IF1' may be connected to different pins of the first scan driver GIC1. In an embodiment, the different pins may be different electrical nodes. The first additional inspection line IL1' may extend from the first additional receiving terminal IR1' to the first additional feedback terminal IF1' and may extend to cross the scan lines, for example.

The second additional inspection line IL2' may include a second additional receiving terminal IR2' connected to the first scan driver GIC1 and a second additional feedback terminal IF2' connected to the first scan driver GIC1. The second additional receiving terminal IR2' and the second additional feedback terminal IF2' may be connected to different pins of the first scan driver GIC1. In an embodiment, the different pins may be different electrical nodes. The second additional inspection line IL2' may extend from the second additional receiving terminal IR2' to the second additional feedback terminal IF2' and may extend to cross the scan lines, for example.

In the illustrated embodiment, the first area AR1 may include two or more inspection lines IL1 and IL1'.

In an embodiment, the first additional inspection line IL1' may have a different length from the first inspection line ILL for example. Accordingly, it is possible to easily inspect the RC delay for the first scan output lines having different lengths.

In an embodiment, the first additional inspection line IL1' may be used to inspect the RC delay of the data lines, and the first inspection line IL1 may be used to inspect the RC delay of the first scan output lines, for example. In an embodiment, the width, thickness, material, and the like of the first additional inspection line IL1' may be configured the same as those of the data lines, and the width, thickness, material, and the like of the first inspection line IL1 may be configured the same as those of the first scan output lines, for example.

Also, the second area AR2 may include two or more inspection lines IL2 and IL2'. Since descriptions of the inspection lines IL2 and IL2' may be the same as those of the inspection lines IL1 and IL1', duplicate descriptions will be omitted.

Figure 7:
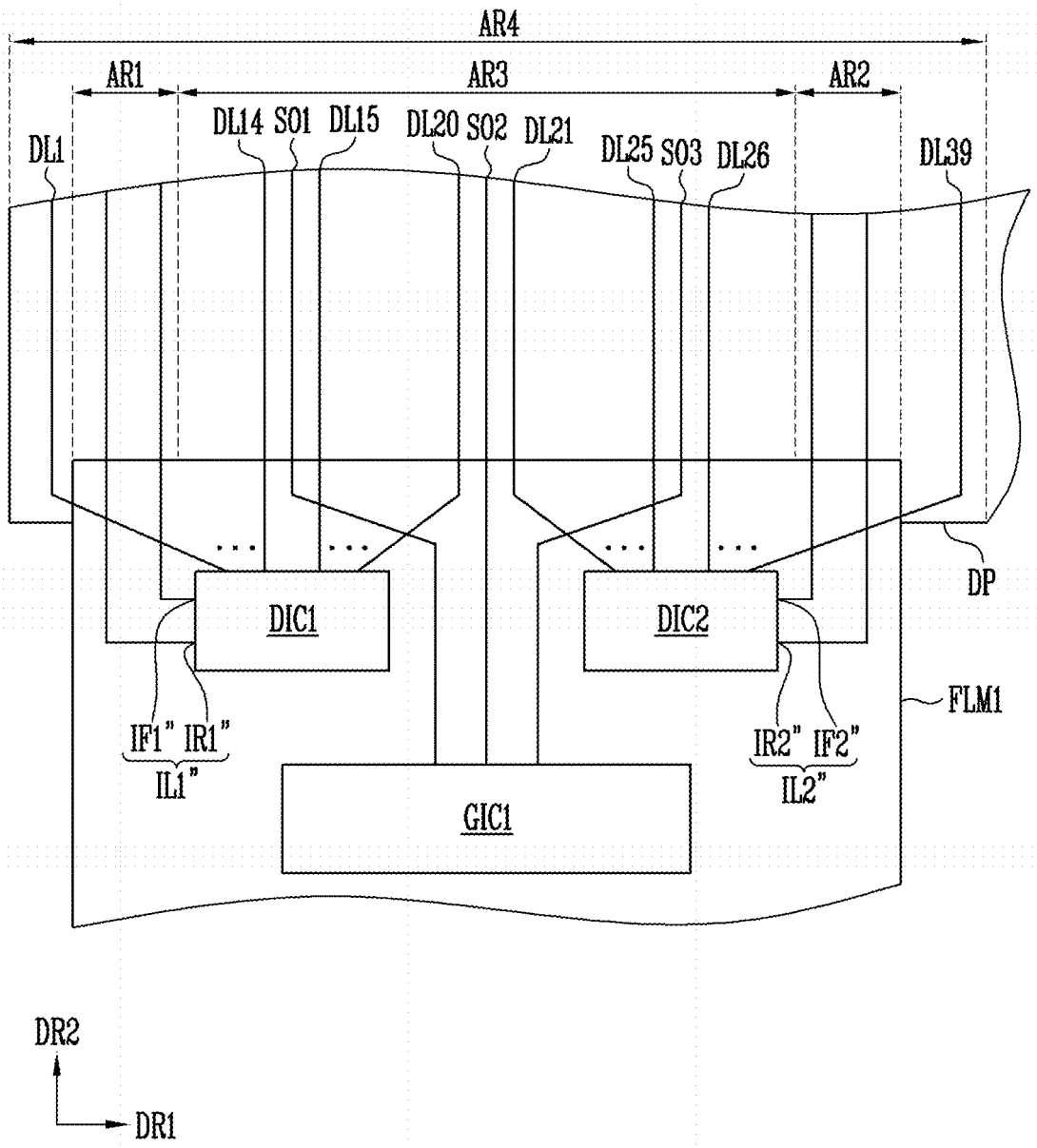
FIG. 7 is a diagram for explaining another embodiment of a first circuit board in another embodiment of the invention.

FIG. 7 is a diagram for explaining another embodiment of a first circuit board in another embodiment of the invention.

As a difference from the first circuit board FLM1 of FIG. 4, in the first circuit board FLM1 of FIG. 7, a first inspection line IL1" may be connected to the first data driver DIC1, and a second inspection line IL" may be connected to the second data driver DIC2.

The first inspection line IL1" may include a first receiving terminal IR1" connected to the first data driver DIC1 and a first feedback terminal IF1" connected to the first data driver DIC1, may extend from the first receiving terminal IR1" to the first feedback terminal IF1", and may extend to cross the scan lines.

The second inspection line IL2" may include a second receiving terminal IR2" connected to the second data driver DIC2 and a second feedback terminal IF2" connected to the second data driver DIC2, may extend from the second receiving terminal IR2" to the second feedback terminal IF2", and may extend to cross the scan lines. In an embodiment, the second inspection line IL2" may be longer than the first inspection line IL1", for example.

Further, as a difference from the first circuit board FLM1 of FIG. 4, the first circuit board FLM1 of FIG. 7 may not include the delay lines ODL1 and ODL2.

In an embodiment, the first data driver DIC1 may output a first inspection signal to the first receiving terminal IR1", receive a first feedback signal for the first inspection signal from the first feedback terminal IF1", and determine time points at which data voltages are applied to a part of the data lines DL1 to DL14 and DL15 to DL20 based on the first inspection signal and the first feedback signal, for example.

In an embodiment, the second data driver DIC2 may output a second inspection signal to the second receiving terminal IR2", receive a second feedback signal for the second inspection signal from the second feedback terminal IF2", and determine time points at which data voltages are applied to another part of the data lines DL21 to DL25 and DL26 to DL39 based on the second inspection signal and the second feedback signal, for example.

In the illustrated embodiment, since the delay lines ODL1 and ODL2 are not included, there is an advantage that the configuration cost may be reduced.

The display device according to the invention may compensation for the change in the RC delay over time, and the line for inspecting the RC delay may not constitute the dead space.

The drawings referred to heretofore and the detailed description of the invention described above are merely illustrative of the invention. It is to be understood that the invention has been disclosed for illustrative purposes only and is not intended to limit the meaning or scope of the invention as set forth in the claims. Therefore, those skilled in the art will appreciate that various modifications and equivalent embodiments are possible without departing from the scope of the invention. Accordingly, the true scope of the invention should be determined by the technical idea of the appended claims.

What is claimed is:

1. A display device comprising:

a display panel including scan lines and pixels connected to the scan lines;

a first scan driver disposed outside the display panel;

first scan output lines including a first terminal connected to the first scan driver and a second terminal connected to a corresponding scan line of the scan lines, and crossing the scan lines; and a first inspection line including a first receiving terminal connected to the first scan driver and a first feedback terminal connected to the first scan driver, extending from the first receiving terminal to the first feedback terminal, and crossing the scan lines.

2. The display device of claim 1, further comprising:
a second inspection line including a second receiving terminal connected to the first scan driver and a second feedback terminal connected to the first scan driver, extending from the second receiving terminal to the second feedback terminal, and crossing the scan lines,
wherein the second inspection line is longer than the first inspection line.

3. The display device of claim 2, further comprising:
a second scan driver disposed outside the display panel; and
second scan output lines including a first terminal connected to the second scan driver and a second terminal connected to a corresponding scan line of the scan lines, and crossing the scan lines,
wherein the scan lines connected to the first scan output lines are not connected to the second scan output lines.

4. The display device of claim 3, wherein the second scan output lines are longer than the first scan output lines.

5. The display device of claim 4, further comprising:
a third inspection line including a third receiving terminal connected to the second scan driver and a third feedback terminal connected to the second scan driver, extending from the third receiving terminal to the third feedback terminal, and crossing the scan lines,
wherein the third inspection line is longer than the first inspection line and the second inspection line.

6. The display device of claim 5, further comprising:
a fourth inspection line including a fourth receiving terminal connected to the second scan driver and a fourth feedback terminal connected to the second scan driver, extending from the fourth receiving terminal to the fourth feedback terminal, and crossing the scan lines,
wherein the fourth inspection line is longer than the first inspection line, the second inspection line, and the third inspection line.

7. The display device of claim 6, further comprising:
a third scan driver disposed outside the display panel; and
third scan output lines including a first terminal connected to the third scan driver and a second terminal connected to a corresponding scan line of the scan lines, and crossing the scan lines,
wherein the scan lines connected to the first scan output lines are connected to the third scan output lines.

8. The display device of claim 7, further comprising:
a first circuit board on which the first scan driver is disposed;
a second circuit board on which the second scan driver is disposed;
a third circuit board on which the third scan driver is disposed;
a first auxiliary circuit board connected to the first circuit board and the second circuit board; and
a second auxiliary circuit board connected to the third circuit board.

9. The display device of claim 1, further comprising:
a first data driver disposed outside the display panel;
data lines including a first terminal connected to the first data driver and a second terminal connected to corresponding pixels of the pixels, and crossing the scan lines; and
a delay line including a first terminal connected to the first data driver and a second terminal connected to the first scan driver.

10. The display device of claim 9, wherein the first scan driver outputs an inspection signal to the first receiving terminal, receives a feedback signal for the inspection signal from the first feedback terminal, and generates a delay signal based on the inspection signal and the feedback signal, and
wherein the first data driver receives the delay signal through the delay line.

11. The display device of claim 10, wherein the first data driver determines time points at which data voltages are applied to the data lines based on the delay signal.

12. The display device of claim 9, wherein the data lines include first data lines connected to pixels of a first color among the pixels, second data lines connected to pixels of a second color among the pixels, and third data lines connected to pixels of a third color among the pixels,
wherein the first color, the second color, and the third color are different from one another, and
wherein the first scan output lines extend between the first data lines and the second data lines closest to the first data lines.

13. The display device of claim 12, wherein the first inspection line further includes:
a first portion extending between one first data line and one second data line closest to the one first data line;
a second portion extending between another first data line and another second data line closest to the another first data line; and
a third portion crossing at least one of the first data lines and at least one of the second data lines, and connecting the first portion and the second portion.

14. The display device of claim 1, wherein the first inspection line and the first scan output lines do not cross each other in an area in which the pixels are disposed.

15. The display device of claim 2, wherein the first inspection line is disposed in a first area of the display panel,
wherein the second inspection line is disposed in a second area of the display panel,
wherein the first scan output lines are disposed in a third area of the display panel,
wherein the first area, the second area, and the third area do not overlap each other, and
wherein the third area is disposed between the first area and the second area.

16. The display device of claim 15, wherein data lines connected to the pixels are disposed in a fourth area of the display panel, and
wherein the fourth area includes the first area, the second area, and the third area.

17. A display device comprising:
a display panel including scan lines, data lines, and pixels connected to the scan lines and the data lines;
a first scan driver disposed outside the display panel;
a first data driver disposed outside the display panel and connected to a part of the data lines;
first scan output lines including a first terminal connected to the first scan driver and a second terminal connected to a corresponding scan line of the scan lines, and crossing the scan lines; and
a first inspection line including a first receiving terminal connected to the first data driver and a first feedback terminal connected to the first data driver, extending from the first receiving terminal to the first feedback terminal, and crossing the scan lines.

18. The display device of claim 17, further comprising:
a second data driver disposed outside the display panel and connected to another part of the data lines; and
a second inspection line including a second receiving terminal connected to the second data driver and a second feedback terminal connected to the second data driver, extending from the second receiving terminal to the second feedback terminal, and crossing the scan lines, wherein the second inspection line is longer than the first inspection line.

19. The display device of claim 18, wherein the first data driver outputs a first inspection signal to the first receiving terminal, receives a first feedback signal for the first inspection signal from the first feedback terminal, and determines time points at which data voltages are applied to some of the data lines based on the first inspection signal and the first feedback signal.

20. The display device of claim 19, wherein the second data driver outputs a second inspection signal to the second receiving terminal, receives a second feedback signal for the second inspection signal from the second feedback terminal, and determines time points at which data voltages are applied to others of the data lines based on the second inspection signal and the second feedback signal.

* * * * *